US007004060B2

(12) United States Patent
Huang et al.

(10) Patent No.: US 7,004,060 B2
(45) Date of Patent: Feb. 28, 2006

(54) BALANCING VERTICAL LOAD DEVICE FOR A MOTOR

(75) Inventors: Guo-Shing Huang, Hsinchu (TW); Chun-Ming Li, Hsinchu Hsien (TW); Gia-Hung Hung, Hsinchuang (TW); Hung-I Lin, Chutung Chen (TW); Ching-Guo Huang, Tainan (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 10/702,163

(22) Filed: Nov. 4, 2003

(65) Prior Publication Data

US 2005/0091971 A1 May 5, 2005

(51) Int. Cl.
*F15B 13/16* (2006.01)

(52) U.S. Cl. ..... 91/390; 60/410

(58) Field of Classification Search ..... 91/390; 60/410, 412, 409, 706, 711
See application file for complete search history.

(56) References Cited

U.S. PATENT DOCUMENTS

| | | | | |
|---|---|---|---|---|
| 3,894,476 | A * | 7/1975 | Cobb | 91/390 |
| 5,303,549 | A * | 4/1994 | Berchtold et al. | 60/414 |
| 5,425,237 | A * | 6/1995 | Suer | 60/711 |
| 6,041,597 | A * | 3/2000 | Huang | 60/415 |

* cited by examiner

*Primary Examiner*—Edward K. Look
*Assistant Examiner*—Michael Leslie
(74) *Attorney, Agent, or Firm*—Pro-Techtor Int'l Service

(57) ABSTRACT

A balancing vertical load device for a motor, to be used in conjunction with a vertical driving device with a force- and position-controlled motor, comprising a motor assembly and a sealed air pressure system. The motor assembly has a motor, and a load weight which, driven by the motor, performs a vertical movement. The sealed air pressure system has an air cylinder, a piston, gliding inside the air cylinder with low friction and being connected with the load weight, an air container, storing a relatively large air volume, and an air pressure source. The sealed air pressure system balances a load of the load weight, so that precise control of force and position of a vertically moving object, as if moving horizontally, is achieved.

4 Claims, 2 Drawing Sheets

BALANCING VERTICAL LOAD DEVICE FOR A MOTOR

FIELD OF THE INVENTION

The present invention relates to a balancing vertical load device for a motor, particularly to a balancing device for a motor having an air container and an air cylinder of large capacity and operating with a closed air pressure system at low friction, offering complete horizontal balance and control of vertical positions and forces of a motor, so that precise micro-control of any positions is achieved.

DESCRIPTION OF RELATED ART

For precise control of force and position of a motor, e.g., for application in chip bonder, loads, which influence precise control of vertical working position and force, need to be balanced. For applications in optoelectronics and semiconductor manufacturing process, balancing of loads demands appropriate cleanness.

Conventionally, load balancing devices having voice coil motors are used for precise position and force control. A load balancing device having a voice coil motor achieves balancing by using either a spring or a weight. These two types, although being usable in a clean process, do not allow for precise adjusting upon replacing a spring or a weight and are thus not suitable for very small loads.

Furthermore, control devices which use oil pressure circuits, like those disclosed in Taiwan patent publication no. 230546 "weight distribution control device using a vertically moving shaft", or sealed oil pressure circuits, like those disclosed in U.S. Pat. No. 6,041,597, allow for improved fine-adjusting, but are not suitable for clean processes.

To summarize, conventional art does not offer devices that both offer precision control of forces and positions and are suitable for clean processes.

SUMMARY OF THE INVENTION

It is therefore an object of the present invention to provide a balancing vertical load device for a motor with increased precision of force and position control, using a sealed air pressure system to drive a vertical movement. The present invention a motor assembly and a sealed air pressure system. The motor assembly has a motor, and a load weight which, driven by the motor, performs a vertical movement. The sealed air pressure system has an air cylinder, a piston, gliding inside the air cylinder with low friction and being connected with the load weight, an air container, storing a relatively large air volume, and an air pressure source. The sealed air pressure system balances the load weight, so that precise control of force and position of a vertically moving object, as if moving horizontally, is achieved.

The present invention can be more fully understood by reference to the following description and accompanying drawings.

DETAILED DESCRIPTION OF THE PREFERRED EMBODIMENT

Figure 1:
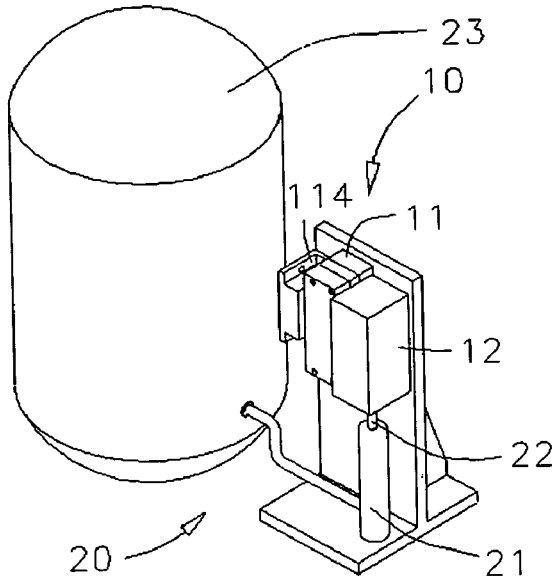
FIG. 1 is a perspective view of the balancing vertical load device for a motor of the present invention.

The balancing vertical load device for a motor of the present invention comprises a motor assembly 10 and a sealed air pressure system 20. The motor assembly 10 has a motor 11 and a load weight 12. The sealed air pressure system 20 has an air cylinder 21, in which a piston 22 is gliding vertically with low friction and which is connected with an air container 23. These structural parts allow precise control of force and position and are suitable for a clean process, as is described in detail below.

Figure 2:
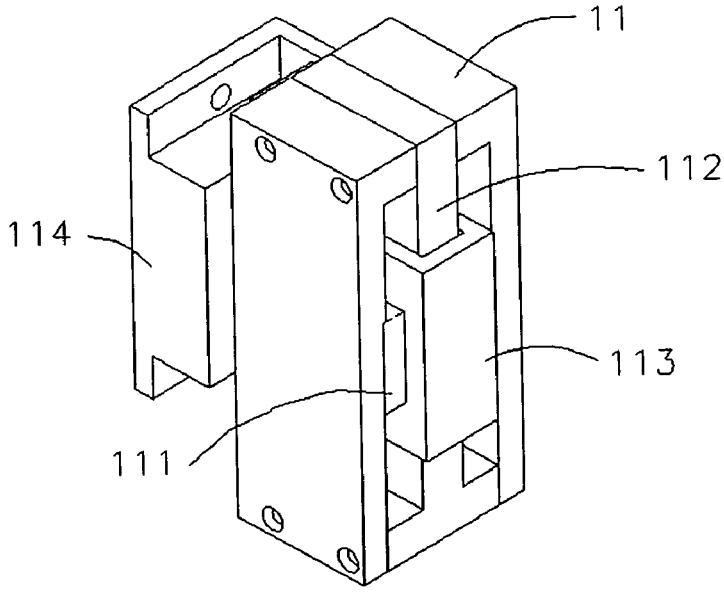
FIG. 2 is a perspective view of the motor assembly of the present invention.
Figure 3:
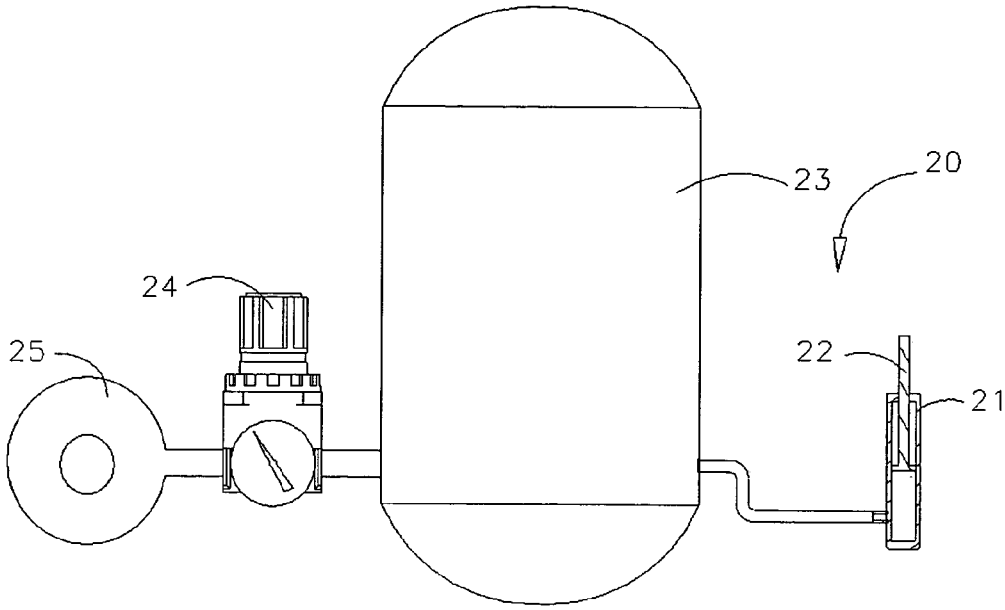
FIG. 3 is a sectional view of the sealed air pressure system of the present invention.

As shown in FIGS. 1–3, the motor 11 is a driving source, having a side on which the load weight 12 is mounted. The air container 23 stores a large quantity of air. An air pressure source 25 is via a valve 24 connected with the air container 23.

The motor is a voice coil motor, having an inner part made of magnetic steel 111 and a stator core of ferromagnetic material 112, which form a permanent magnet. Upon change of an electric current through the coil 113 a mechanic force results that pushes the load weight 12. The motor 11 has a digital linear array 114 for indicating a linear position of the electric coil 113, in turn for controlling the electric current through the electric coil 113 and thus the output of the motor 11 and the vertical position thereof.

The load weight 12 is driven by the motor 11, performing a vertical movement. The piston 22 is attached to the load weight 12, moving along with the vertical movement of the load weight 12. Due to the limited cross-sectional area of the cylinder 21, the vertical movement of the piston 21 changes the air volume of the air container only by a negligible quantity, so that approximately a constant volume of the sealed air pressure system 20 is maintained.

The valve 24 is used to adjust air pressure in the air container to balance the load on the load weight 12. In various vertical positions of the load weight 12 and during rapid vertical movements thereof, the balance will not be affected or deviations therefrom can be ignored, so that in any vertical position of the motor 11 precise control of force and position is achieved.

Figure 4:
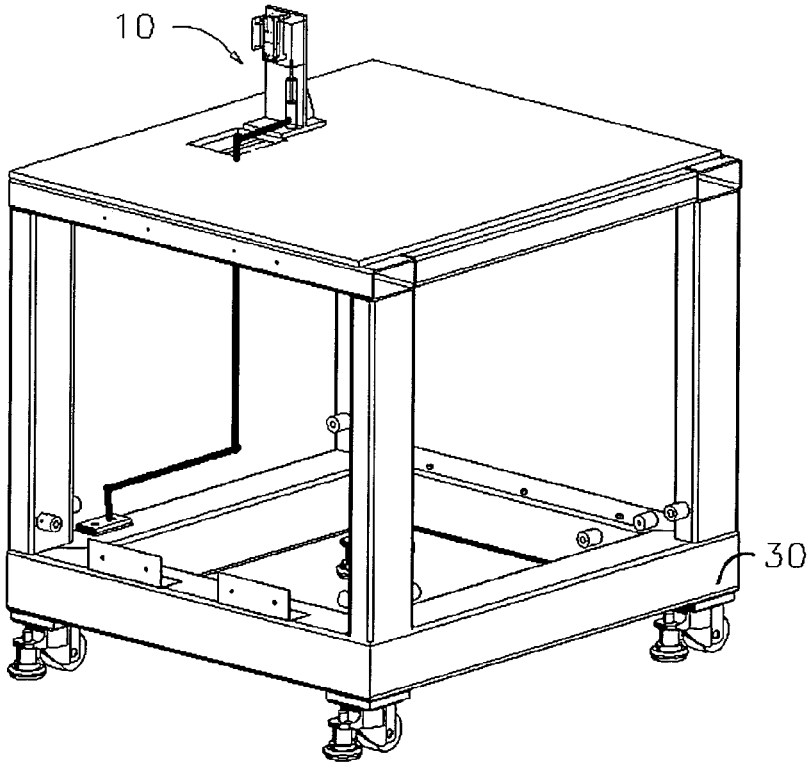
FIG. 4 is a perspective view of the balancing vertical load device for a motor of the present invention installed on a frame.

Referring to FIG. 4, the balancing device for a motor of the present invention is preferably mounted on a frame 30, taking advantage of space within the frame as the volume of the air container 23, so that no additional space is needed therefor.

To summarize, the present invention uses the air container 23 and the air cylinder 21 to achieve near balance with the load weight 12 of the motor assembly 10 (as a vertically moving structural part), enhancing precision of force and position control. Since the sealed air pressure system 20 is not readily exposed to pollution, usage in a clean process is possible.

While the invention has been described with reference to a preferred embodiment thereof, it is to be understood that modifications or variations may be easily made without departing from the spirit of this invention which is defined by the appended claims.

What is claimed is:

1. A balancing vertical load device for a linear motor, to be used in combination with a vertical driving device with controlled force and positioning, comprising:

a linear motor assembly having a permanent magnet stator core, and a moving coil surrounding said stator core and being slideable in a linear motion thereto;

a digital linear array indicating the linear position of said moving coil;

a load weight which, driven by said motor, performs a vertical movement; and a sealed air pressure system, comprising an air cylinder, a piston gliding inside said air cylinder with low friction and being connected with said load weight, an air containers storing an air volume;

whereby said sealed air system balances a load of said load weight, so that precise control of force and position of a vertically moving object, as if moving horizontally, is achieved.

2. A balancing vertical load device for a linear motor according to claim 1, wherein said linear motor assembly has a digital linear array feed back system for vertical position and force control.

3. A balancing vertical load device for a linear motor according to claim 1, wherein a valve is inserted between an air pressure source and said air container for adjusting air pressure in said air container to modify balancing force.

4. A balancing vertical load device for a linear motor according to claim 1, wherein said linear motor and said sealed air pressure system are mounted on a frame, with space within said frame being used for said air container.

* * * * *